US011255168B2

(12) United States Patent
Loehken et al.

(10) Patent No.: US 11,255,168 B2
(45) Date of Patent: Feb. 22, 2022

(54) PERFORATING SYSTEM WITH AN EMBEDDED CASING COATING AND EROSION PROTECTION LINER

(71) Applicant: DynaEnergetics Europe GmbH, Troisdorf (DE)

(72) Inventors: Joern Olaf Loehken, Troisdorf (DE); Liam McNelis, Bonn (DE); Bernd Fricke, Hannover (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/215,159

(22) Filed: Mar. 29, 2021

(65) Prior Publication Data

US 2021/0301632 A1 Sep. 30, 2021

Related U.S. Application Data

(60) Provisional application No. 63/064,453, filed on Aug. 12, 2020, provisional application No. 63/001,710, filed on Mar. 30, 2020.

(51) Int. Cl.
*E21B 43/117* (2006.01)
*F42B 1/032* (2006.01)
(Continued)

(52) U.S. Cl.
CPC ..... *E21B 43/117* (2013.01); *B22F 7/008* (2013.01); *C23C 24/06* (2013.01); *F42B 1/028* (2013.01);
(Continued)

(58) Field of Classification Search
None
See application file for complete search history.

(56) References Cited

U.S. PATENT DOCUMENTS 3,255,659 A 6/1966 Venghiattis
3,375,108 A 3/1968 Wyman et al.
(Continued)

FOREIGN PATENT DOCUMENTS

AU 741792 B2 12/2001
DE 19630339 A1 1/1997
(Continued)

OTHER PUBLICATIONS

Global Tungsten and Powders, EnerMetTM Tungsten Powders for the Oil & Gas Industry, Technical Information Bulletin, 2017, 2 pgs., https://www.globaltungsten.com/fileadmin/user_upload/EnerMet_Powders.pdf.

(Continued)

*Primary Examiner* — George Wyszomierski
(74) *Attorney, Agent, or Firm* — Moyles IP, LLC

(57) ABSTRACT

A shaped charge liner may include an apex portion and a skirt portion extending from the apex portion. The skirt portion may include a body connected to the apex portion, a perimeter spaced apart from the apex portion, and a carbide layer extending between and spaced apart from the perimeter and the apex portion. A shaped charge for creating a perforation hole in a wellbore casing may include a shaped charge liner having at least one material having hardness that is greater than a corresponding hardness of the wellbore casing. The at least one material is configured to bond to at least one of an outer surface and an inner surface of the perforation hole upon detonation of the shaped charge and penetration of the casing by a perforation jet.

18 Claims, 16 Drawing Sheets

(51) Int. Cl.

| | |
|---|---|
| ***B22F 7/00*** | (2006.01) |
| ***C23C 24/06*** | (2006.01) |
| ***F42B 1/028*** | (2006.01) |
| *C23C 24/00* | (2006.01) |

(52) U.S. Cl.

CPC ..... *F42B 1/032* (2013.01); *B22F 2301/20* (2013.01); *B22F 2302/10* (2013.01); *B22F 2302/20* (2013.01); *C23C 24/00* (2013.01)

(56) References Cited

U.S. PATENT DOCUMENTS

| | | | | |
|---|---|---|---|---|
| 3,589,453 | A * | 6/1971 | Venghiattis | E21B 43/117 175/4.6 |
| 4,499,830 | A | 2/1985 | Majerus et al. | |
| 6,925,924 | B2 | 8/2005 | Baker et al. | |
| 7,011,027 | B2 | 3/2006 | Reese et al. | |
| 7,522,103 | B2 | 4/2009 | Wood | |
| 7,658,148 | B2 | 2/2010 | Langan et al. | |
| 7,721,649 | B2 | 5/2010 | Hetz et al. | |
| 7,849,919 | B2 | 12/2010 | Wood et al. | |
| 8,220,394 | B2 | 7/2012 | Bates et al. | |
| 8,322,284 | B2 | 12/2012 | Meddes et al. | |
| 8,544,563 | B2 | 10/2013 | Bourne et al. | |
| 8,584,772 | B2 | 11/2013 | Yang et al. | |
| 8,701,767 | B2 | 4/2014 | Andrzejak et al. | |
| 8,794,153 | B2 | 8/2014 | Glenn | |
| 9,187,990 | B2 | 11/2015 | Xu | |
| 9,347,119 | B2 | 5/2016 | Xu | |
| 9,612,095 | B2 | 4/2017 | Smart et al. | |
| 10,376,955 | B2 | 8/2019 | Loehken | |
| 10,612,343 | B2 | 4/2020 | Hess et al. | |
| 2011/0155013 | A1 | 6/2011 | Boyer et al. | |
| 2013/0056208 | A1* | 3/2013 | Xu | E21B 43/117 166/298 |
| 2013/0340643 | A1* | 12/2013 | Yang | F42B 1/036 102/306 |
| 2016/0169639 | A1* | 6/2016 | Smart | F42B 1/028 102/306 |
| 2018/0372460 | A1 | 12/2018 | Loehken et al. | |

FOREIGN PATENT DOCUMENTS

| | | | |
|---|---|---|---|
| EP | 2598830 | A1 | 6/2013 |
| EP | 1682846 | B1 | 1/2014 |
| EP | 3144630 | B1 | 1/2020 |
| GB | 916870 | A | 1/1963 |
| WO | 2006054081 | A1 | 5/2006 |
| WO | 2021123041 | A1 | 6/2021 |

OTHER PUBLICATIONS

Murr, Ballistic and Hypervelocity Impact and Penetration, Metallurgical and Materials Engineering, The University of Texas at El Paso, El Paso, TX, USA, 2014, 54 pgs., https://link.springer.com/referenceworkentry/10.1007%2F978-3-319-01905-5_49-1.

Cinca, et al.; An Overview of Intermetallics Research and Application: Status of Thermal Spray Coatings; Journal of Materials Research and Technology; dated Mar. 13, 2013.

Zhang, et al.; Effect of Powder Particle Size and Spray Parameters on the Ni/Al Reaction During Plasma Spraying of Ni—Al Composite Powders; Journal of Thermal Spray Technology; dated Jan. 25, 2021; https://link.springer.com/article/10.1007/s11666-020-01150-2.

Church, et al.; Investigation of a Nickel-Aluminum Reactive Shaped Charge Liner; Journal of Applied Mechanics; vol. 80; dated May 2013; 13 pages.

Eakins, et al., Shock compression of reactive powder mixtures; International Materials Reviews; vol. 54, No. 4; pp. 181-213; dated 2009; 33 pages.

European Patent Office; Decision revoking the European Patent No. 2598830; dated Nov. 28, 2017; 17 pages.

International Searching Authority; International Search Report and Written Opinion of the International Searching Authority for PCT/EP2021/057148; dated Jul. 29, 2021; 12 pages.

Qinetiq; Notice of Opposition of EP Patent 3568664; dated Aug. 11, 2021; 7 pages.

Qinetiq; Third Party Observations according to Article 115EPC in relation to European Patent Applications EP17828873.4 and EP17835626.7; dated Aug. 20, 2019; 1 page.

Qinetiq; Third Party Observations according to Article 115EPC in relation to European Patent Applications EP17828873.4 and EP17835626.7; dated Feb. 20, 2020; 3 pages.

Qinetiq; Third Party Observations according to Article 115EPC in relation to European Patent Applications EP17828873.4 and EP17835626.7; dated May 26, 2020; 1 page.

* cited by examiner

PERFORATING SYSTEM WITH AN EMBEDDED CASING COATING AND EROSION PROTECTION LINER

CROSS-REFERENCE TO RELATED APPLICATIONS

This application claims the benefit of U.S. Provisional Patent Application No. 63/064,453 filed Aug. 12, 2020 and U.S. Provisional Patent Application No. 63/001,710 filed Mar. 30, 2020, the entire contents of which are incorporated herein by reference.

BACKGROUND OF THE DISCLOSURE

Hydraulic fracturing is a commonly-used method for extracting oil and gas from geological hydrocarbon bearing formations such as shale and other tight-rock formations. Hydraulic fracturing is known to be a time-consuming and labor-intensive operation, which involves drilling a wellbore, installing casings in the wellbore, perforating the wellbore, pumping high-pressure fracking fluids into the wellbore and the geological formation, and collecting the liberated hydrocarbons.

Shaped charges are commonly used to enable hydraulic fracturing in highly horizontal wells in so called perf and plug operations. To fracture the rocks in the reservoir, the horizontal wellbore is divided into sections or so-called stages, which are individually and sequentially treated. To do so, one stage is pressure isolated from the toe section of the wellbore using a plug and subsequentially perforated over a longer interval. This is typically done by pumping down a tool string into the wellbore. The tool string is typically attached to a wireline that is controlled at the surface of the wellbore. The tool string typically includes several perforating guns, a setting tool, and a disposable plug. The perforating guns are usually cylindrical and include a detonating cord arranged within the interior of the assembly and connected to shaped charges, hollow charges, or perforators disposed therein. Shaped charges are explosive components configured to focus ballistic energy onto a target. When the detonating cord initiates the explosive load within the shaped charge, a liner, and/or other materials within the shaped charge are collapsed and propelled out of the shaped charge in a perforating jet of thermal energy and solid material. In particular, the shaped charges may be used for, among other things, any or all of generating holes in downhole pipe/tubing (such as a steel casing) to gain access to an oil/gas deposit formation and to create flow paths for fluids used to clean and/or seal off a well and perforating the oil/gas deposit formation to liberate the oil/gas from the formation. The shaped charges may be designed such that the physical force, heat, and/or pressure of the perforating jet, expelled materials, and shaped charge explosion will perforate or form entrance openings/holes in the target, which may include, among other things, steel, concrete, and geological formations.

A typical shaped charge is illustrated in FIG. 1. The shaped charge 10 includes a shaped charge case 12. A shaped charge liner 14 is positioned in the shaped charge case 12. The shaped charge liner 14 is formed from a plurality of powders 11, and includes a closed apex portion 16 and an open portion 18. Upon detonation of the shaped charge 10, a perforation 30 is formed in a target 20 (see FIG. 2). A typical perforation 30 formed by the shaped charge 10 of FIG. 1 is illustrated in FIG. 2. The typical perforation 30 includes a perforation hole in a casing plate or wellbore tubular. The geometry of the perforation hole, which extends through the material wall thickness of the wellbore casing, may be have a shape similar to that of a cylinder, funnel, trapeze, or venturi funnel. The point where the perforation hole begins to form through the casing typically includes a raised edge or small piece of the casing plate or wellbore that remains attached to the casing plate or wellbore after the shaped charge has been detonated. The raised edge is referred to as a burr or inlet burr. The shape of the perforation hole, as well as the size and form of the burr can have a significant influence on the erosion rate of the perforation hole size when fluid is pumped through the perforation hole during hydraulic fracturing.

While attached to the wireline, the tool string is pumped down the wellbore and is retracted by the wireline into a desired location for setting the plug. After the plug is set, the tool string is retracted further up the wellbore until one of the perforating guns is at a desired perforating zone. Once at the desired perforating zone, the perforating gun is initiated, then the tool string is further retracted to the next perforating zone and another one of the perforating guns is fired. The steps of retracting the tool string and firing a perforating gun may be repeated until the desired amount of perforations are obtained. After the last set of perforations are made, the tool string is retracted to the surface using the wireline.

The size, shape, and consistency of the perforations formed in the perforating zones is critical to the operational efficiency of plug-and-perf methods, and can help provide necessary information so that operators and developers of perforating apparatus can adjust the parameters of the hydraulic fracturing after perforation. The perforation itself acts like an orifice between the wellbore casing and the rock formation. As the diameter of the perforation hole is much smaller than the inner diameter of the wellbore casing, a pressure drop can be observed. A magnitude of the pressure drop can be deduced from Bernoulli's equation and is described by:

$$p_r = \frac{8\rho}{\pi^2 C_D^2 D^4}\left(\frac{Q}{n}\right)^2 = \frac{\rho}{2(AC_D)^2}\left(\frac{Q}{n}\right)^2$$

$Q$ = flow rate, $D = EHD$, $\rho$ = density $A$ = area, $Cd$ = Coefficient of discharge $n$ = number of perforations As can be seen in the equation, the pressure drop is strongly dependent on the diameter of the perforation hole. Preferably, this diameter should remain constant during the complete treatment process to keep the pressure constant over the desired fracture pressure and to avoid variation in pressure and flow rates, which would cause uneven fracture growth between different fractures.

Each perforating interval may be split into smaller parts, so called clusters, where perforations are made. After the perforation, fluids are pumped from the surface downhole to fracture the rock using high hydraulic pressure which exceeds the strength of the rock as well as the local minimal stress in the formation. During a specially tailored pumping schedule, clean fluid, referred to as pre-pad or pad fluid, is first pumped and later replaced by a slurry fluid, which contains coarse sand grains. These grains are pushed into the open fracture and intentionally keep the fracture open when the hydraulic pressure is reduced.

However, the sand grains in the slurry fluid constantly impact against the edge perforation holes in the casing and slowly erode the hole, which leads to an increase in the hole diameter and hence to an increase in flow or decrease in pressure. An example is given in FIG. 3. While the pressure difference over a perforation hole is held approximately constant, the flow rate of the slurry fluid increases with time, which is due to an increase in the perforation hole diameter. Examples of the typical erosion are shown in FIGS. 4A-4B and FIGS. 5A-5B. FIG. 4A shows the perforation hole 30 before erosion and FIG. 4B shows the perforation hole 30 after erosion. FIG. 5A shows the perforation hole 30 before erosion and FIG. 5B shows the perforation hole 30 after erosion. Each of FIGS. 4B and 5B show that the perforation hole increases in size as a result of being eroded by the slurry fluid.

The documentation of information pertaining to the perforations is typically done with a photographic imaging device, which is "run" into the wellbore to verify the accuracy of the perforations formed by the peforating guns previously positioned in the wellbore by the first wireline. The photographic imaging device may also be used to validate various Frac Simulation models. Since the wellbore fluid can be particulary muddy and dark, it may be difficult to capture clear images of the wellbore. Some imaging devices may include one or more of acoustic imaging, night vision, and dark vision. In addition, the perforation holes may be eroded by the wellbore fluid or fracturing fluid, which could result in the initially captured image of perforations being different from the resulting shape and size of the perforations during hydraulic fracturing operations.

There is a need for a shaped charge that increases the wear resistance of perforation holes. There is a further need for a perforating gun system and an associated method that creates perforation holes having a rigid surface that withstands erosion. There is a further need for a perforating system that creates perforation holes that are easily identifiable by imaging devices.

BRIEF DESCRIPTION OF THE EXEMPLARY EMBODIMENTS

According to an aspect, the exemplary embodiments include a shaped charge liner. The shaped charge liner includes an apex portion and a skirt portion extending from the apex portion. The skirt portion includes a body connected to the apex portion, and a perimeter spaced apart from the apex portion. According to an aspect, a layer of material extends between and is spaced apart from the perimeter and the apex portion. The layer of material includes a carbide layer or a metal nitride layer.

In another aspect, the exemplary embodiments include a shaped charge for creating a perforation hole in a wellbore casing. The shaped charge includes a shaped charge liner including at least one material having a hardness that is greater than a corresponding hardness of the wellbore casing. The at least one material may be configured to bond to at least one of an outer surface and an inner surface of the perforation hole upon detonation of the shaped charge and penetration of the casing by a perforation jet.

In a further aspect, the exemplary embodiments include a method of perforating a target. The method includes deploying a perforating gun in a wellbore. According to an aspect, the perforating gun includes a shaped charge. The shaped charge includes a case having a cavity, an explosive load disposed within the cavity of the case, and a shaped charge liner disposed adjacent the explosive load. The liner may include a carbide layer or a nitride layer. The method further includes detonating the shaped charge to create a perforation hole in a target. The created perforation hole may have an inlet burr. Upon detonation of the shaped charge, a carbide material from the carbide layer or nitride material from the nitride layer is deposited onto the inlet burr.

BRIEF DESCRIPTION OF THE DRAWINGS

Devices, systems, and methods for perforating, among other things, wellbore structures and oil and gas deposit formations are generally disclosed.

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
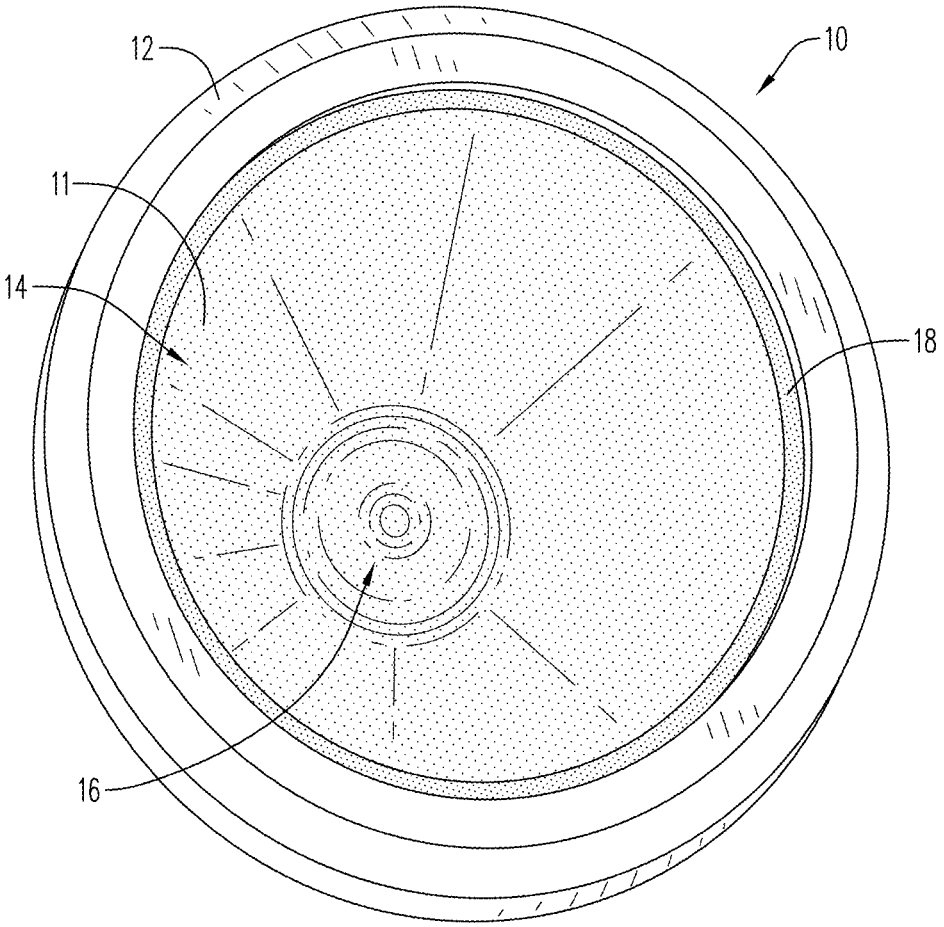
FIG. 1 (PRIOR ART)
FIG. 1 is a top down, perspective view of a shaped charge, according to the prior art.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Embodiments described herein relate generally to perforating gun assemblies, shaped charges for use with perforating gun assemblies, shaped charge liners for use with shaped charges, and methods for creating perforations including a halo in a wellbore. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, exemplary embodiments are introduced and referenced throughout the disclosure.

In the illustrative examples and as seen in FIGS. 6A-6C and 7A-7C, a liner 100 for use in a shaped charge 200 is illustrated. As illustrated in FIGS. 7A-7C and FIGS. 11A-12A, the shaped charge 200, may include a case/shell 210 having a plurality of walls. The plurality of walls may include a side wall and a back wall, that together define a hollow interior/cavity 220 within the case 210. The case 210 includes an inner surface and an outer surface. An explosive load 230 may be positioned within the hollow interior 220 of the case 210, along at least a portion of the inner surface of the shaped charge case 210. According to an aspect, the liner 100 is disposed adjacent the explosive load 230, so that the explosive load 230 is disposed adjacent the side walls and the back walls of the case 210. The shaped charge has an open end, through which a jet is eventually directed, and a back end (closed end), which is typically in communication with a detonating cord (not shown).

Figure 6A:
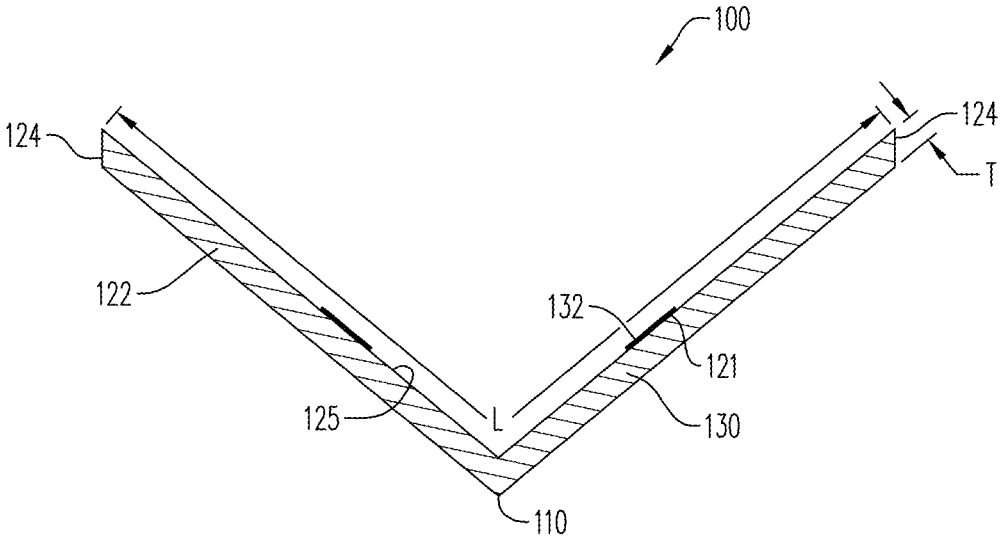
FIG. 6A is a cross-sectional view of a conical shaped charge liner having a layer of material including a carbide layer or a metal nitride layer, according to an embodiment.
Figure 6B:
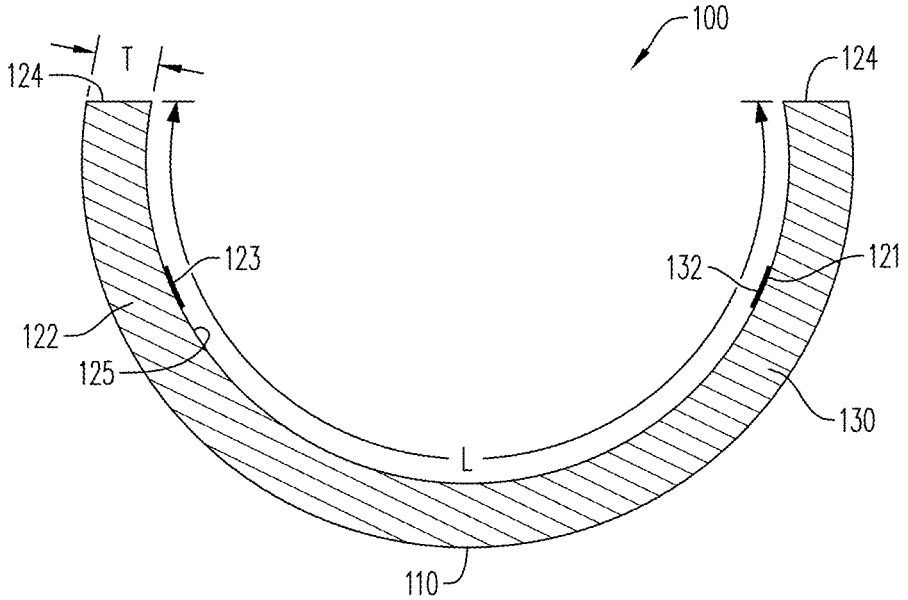
FIG. 6B is a cross-sectional view of a hemispherical shaped charge liner having a layer of material including a carbide layer or a metal nitride layer, according to an embodiment.
Figure 6C:
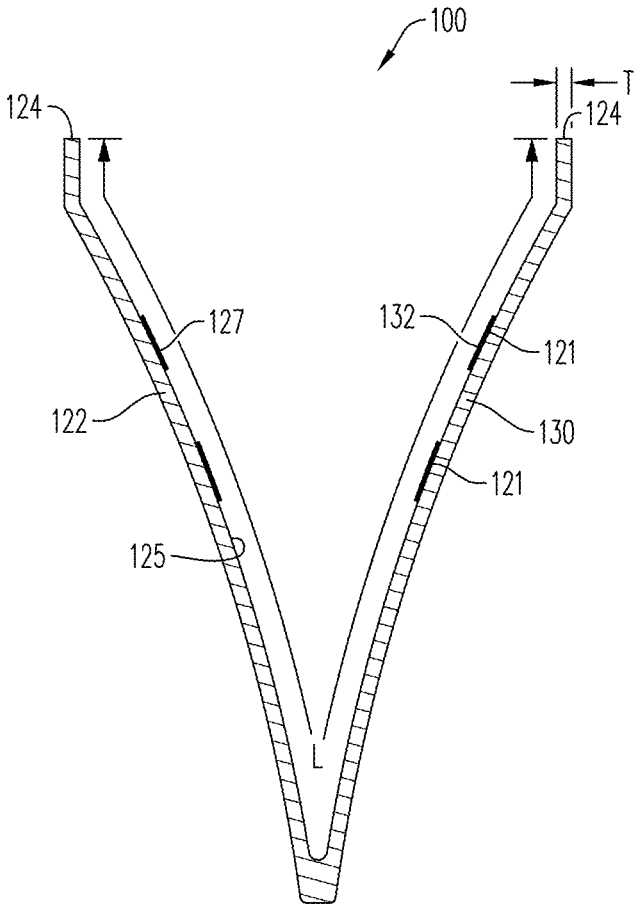
FIG. 6C is a cross-sectional view of a trumpet shaped charge liner having a layer of material including a carbide layer or a metal nitride layer, according to an embodiment.

The illustrative liners 100, as seen for instance in FIGS. 6A-6C, may be formed of a single layer (as shown). In an alternative embodiment, the liner 100 may also include multiple layers (not shown). An example of a multiple-layered liner is disclosed in U.S. Pat. No. 8,156,871, hereby incorporated by reference to the extent that it is consistent with the disclosure. In an embodiment, the shaped charge liner 100 has a thickness T ranging from between about 0.5 mm to about 5.0 mm, as measured along its length L. The thickness T is, in one embodiment uniform along the liner length L, but in an alternative embodiment, the thickness T varies in thickness along the liner length L, such as by being thicker closer to the walls of the case 210 and thinner closer to the center of the shaped charge 200 (or apex portion 110 of the liner 100).

Further, in one embodiment, the liner 100 may extend across the full diameter of the cavity 220 as shown. In an alternative embodiment, the liner 100 may extend only partially across the diameter of the cavity 220, such that it does not completely cover the explosive load 230. The liner 100 may be present in a variety of shapes, including conical shaped as shown in FIG. 6A, hemispherical or bowl-shaped as shown in FIG. 6B, or trumpet shaped as shown in FIG. 6C. The conical, hemispherical, and trumpet liners 100 may be substantially uniform when measured at any position along the length of the liner 10. For instance, a measurement of the constituents of the liner 100 taken at the apex portion of the liner 100 may be identical to another measurement of the constituents of the liner 100 taken at a skirt portion 120 of the liner 100.

The liner 100 includes various powdered metallic and non-metallic materials and/or powdered metal alloys, and binders. The shaped charge liner 100 includes a composition having a plurality of powders 130. The powders may be formed by any powder production techniques, such as, for example, grinding, crushing, atomization, and various chemical reactions.

The shaped charge liner 100 may further include a binder and/or a lubricant that aids with enhancing the producibility and the homogeneity of the composition of the liner 100. According to an aspect, the binder and lubricant may serve as a carrier agent that helps facilitate the homogeneity of the composition. The binder may include a polymer resin, polymer powder, wax, or graphite. According to an aspect, the binder can also be an oil-based material. Other binders may include soft metals such as lead or copper. The lubricant may enhance processability of the powders in the composition. The lubricant may help to bind one or more of the powders in the composition, such as graphite powder, so that during the mixing process, the risk of powder loss due to their fineness or low granularity and/or potential contamination of the work environment is reduced. According to an aspect, the graphite powder may function as the lubricant. In an embodiment, the shaped charge liner 100 additionally includes an oil, which may function as the lubricant and prevent oxidation of the liner 100. The oil may be uniformly intermixed with each of the metal powders and the graphite powder. The oil, even when present in trace amounts, aids with thorough blending/mixing of the powders (having various grain size ranges) of the composition. It is envisioned that each of the powders, the binder, and the lubricant may be uniformly interspersed throughout the liner 100.

A method of forming the shaped charge liner 100 includes mixing a composition of powders to form a powder blend. The composition of powders may include any of the compositions described hereinabove. A mixer is used to thoroughly mix the powders, and may mix the powders at a speed of about 2 revolution/second (revs/sec) to about 4,000 revs/sec, alternatively between about 1,000 rev/sec and 3,000 revs/sec, and alternatively between about 2 revs/sec to about 2,000 revs/sec. Once mixed, the powder blend is formed into a desired liner shape, such as a conical shape, a hemispherical or bowl shape, or a trumpet shape. The liner shape may be formed by compressing the powder blend using a force of up to about 1,500 kN. It is contemplated that providing a hard surface coating on the liner manufacturing tooling will improve the production process for the liner. Such hard surface coating may include a Tin-Nickel coating or a diamond coating.

FIGS. 6A-6C illustrate the shaped charge liner 100 including the apex portion 110 and a skirt portion 120 extending from the apex portion. According to an aspect, the skirt portion 120 has a body 122 connected to the apex portion and a perimeter 124 spaced apart from the apex portion.

The shaped charge liner 100 further includes a layer of material 121 extending between and spaced apart from the perimeter 124 and the apex portion 110. The layer of material 121 includes a carbide layer or a metal nitride layer. Throughout this disclosure, the layer of material 121 may be referred to as a carbide layer or a metal nitride layer.

As understood by one of ordinary skill in the art, carbide refers to a compound that includes carbon and a metal. The layer of material 121, when including a carbide layer includes a carbide material. The layer of material 121, when including a metal nitride layer, includes nitride. The carbide material or the nitride material may be a powder 132 that is mixed with the other powdered components of the shaped charge liner. The powdered carbide may include, for example, tungsten carbide, titanium carbide, tantalum, boron carbide, or any other carbide material. According to an aspect and as described in further detail hereinbelow, the layer of material 121 may be configured to form a coating of carbide material or nitride material on a target surface or in a perforation hole formed in the target surface.

Figure 7A:
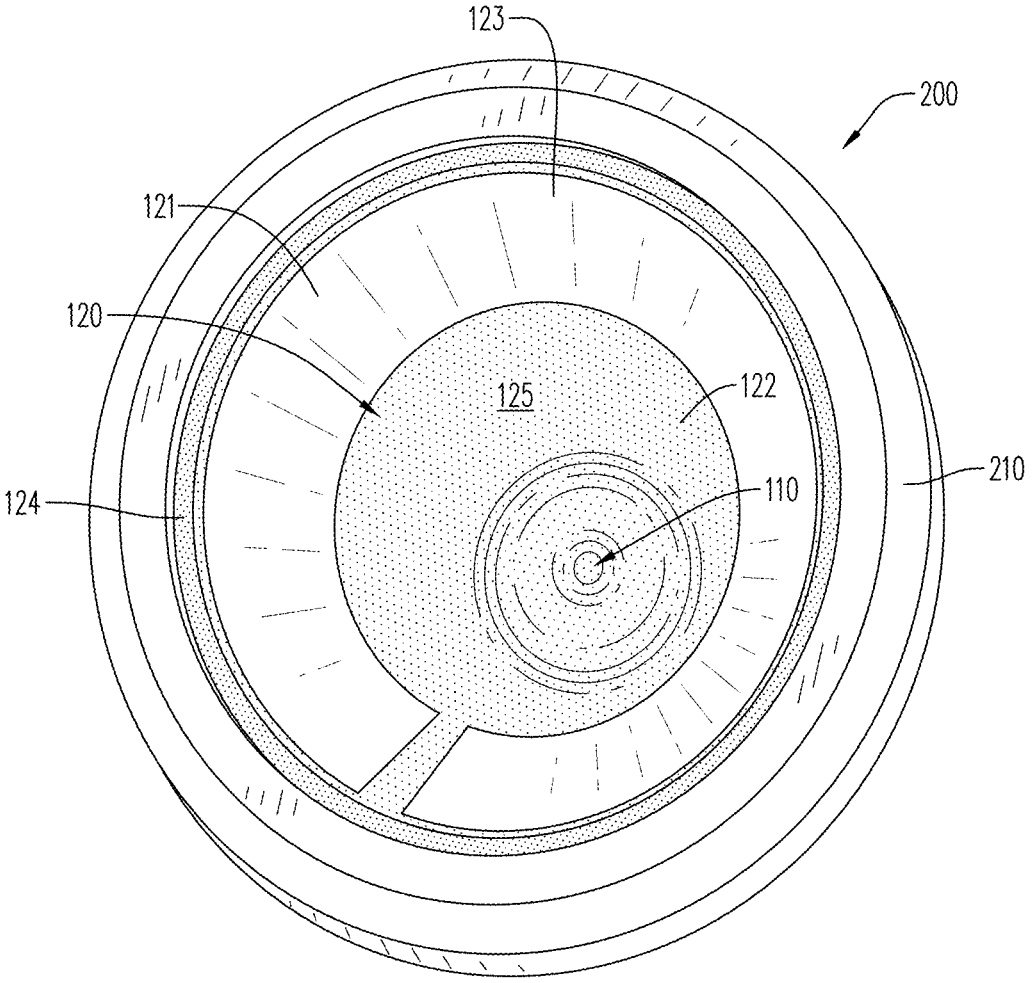
FIG. 7A is a top down, perspective view of a shaped charge for use with a perforating gun assembly, according to an embodiment.

According to an aspect, the layer of material 121 is positioned on, adhered to, or otherwise secured to the surface of the liner 100. For example, and as illustrated in FIG. 7A, the layer of material 121 may include a foil 123 that is adhered to a surface 125 of the body 122 of the shaped charge liner 100. The foil 123 may be provided on a substrate surface along with a layer of carbide or layer of nitride material also provided on the substrate surface. According to an aspect, the foil 123 may be a metal foil. According to an aspect, the foil 123 may ensure an even distribution of carbide or nitride material on the surface of the liner 100. According to an aspect, the thickness of the carbide or nitride material may be from about 20 micrometers (μm) to about 1,000 micrometers (μm).

Figure 7B:
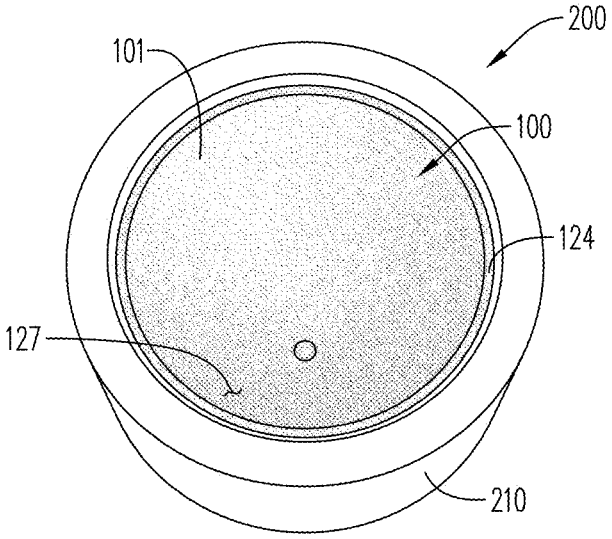
FIG. 7B is a top down, perspective view of a shaped charge including a liner having a surface fully coated with a layer of material including a carbide layer or a metal nitride layer, according to an embodiment.

The layer of material 121 may first be pressed into a desired shape and then positioned on top of the liner. As illustrated in FIG. 7B, the layer of material 121 may have a shape that is similar to the shape of the liner 100 to which the layer of material 121 is secured. For example, the layer of material may have a conical shape as the liner 100 shown in FIG. 6A, a hemispherical or bowl shape as the liner 100 shown in FIG. 6B, or a trumpet shape as the liner 100 shown in FIG. 6C.

Figure 7C:
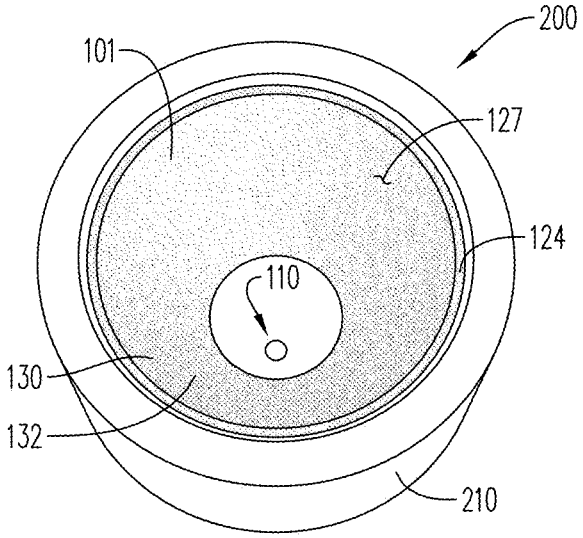
FIG. 7C is a top down, perspective view of a shaped charge including a liner having a surface partially coated with a layer of material including a carbide layer or a metal nitride layer, according to an embodiment.

Alternatively, and as illustrated in FIG. 7C, the layer of material 121 may be provided as a lacquer 127 that is painted onto a surface of the liner 100. The lacquer 127 may include a plurality of carbide powders or nitride powders combined in a mixture of adhesives or softer types of metal powders, such as graphite, which may have a binding quality for harder metals. The lacquer 127 may be painted, sprayed or otherwise applied to a surface 125 of the body 122 of the liner 100.

As illustrated in FIG. 7A and FIG. 7C, for example, the layer of material 121 may be provided on only the open end or the uppermost portion of the liner 100. The layer of material 121 may be provided around the perimeter 124 of the liner 110, so that the layer of material 121 is spaced apart from the apex portion 110 of the liner 100. According to an aspect, the layer of material 121 is provided on an area of the liner 100 measuring between about 10 mm and about 20 mm of the liner 100. In these configurations, the layer of material 121 covers the liner 100 around a substantial portion of a circumference of the liner 100. Alternatively, the layer of material 121 may cover all surface of the liner (FIG. 7B). The layer of material 121 may cover a plurality of different zones on the surface of the liner 100. For example, and as illustrated in FIG. 6C, the layer of material 121 includes a plurality of spaced apart carbide layers or spaced apart nitride layers. The layer of material 121 may extend around all or a substantial portion of the circumference of the liner 100, forming a plurality of ring-like zones of carbide or nitride on the liner 100.

Figure 2:
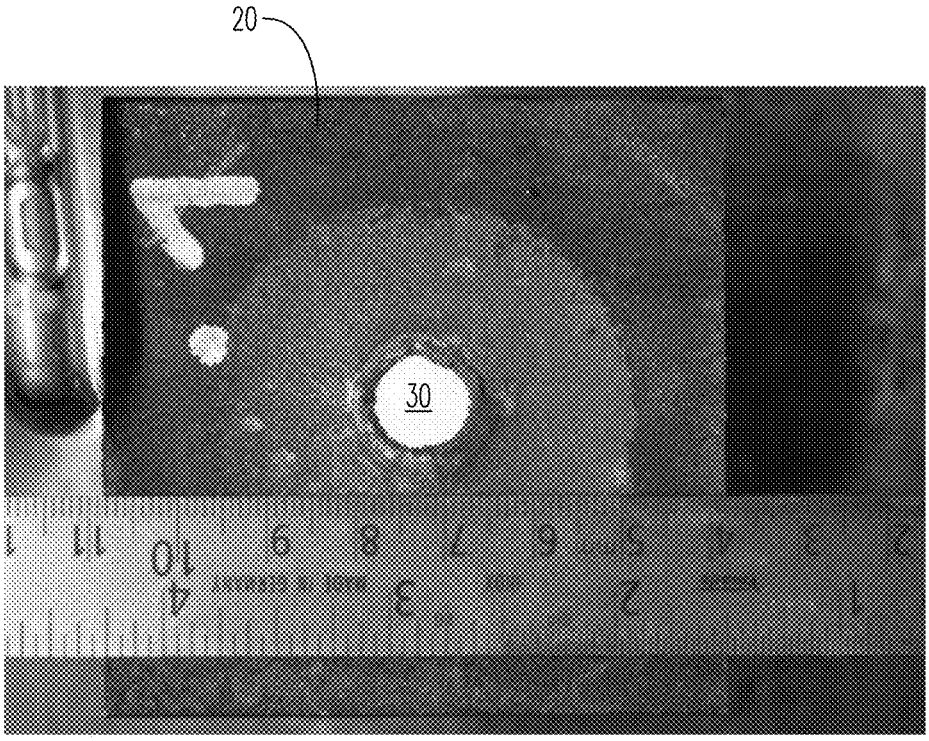
FIG. 2 (PRIOR ART)
FIG. 2 is top view of a perforation hole formed with use of the shaped charge of FIG.
Figure 3:
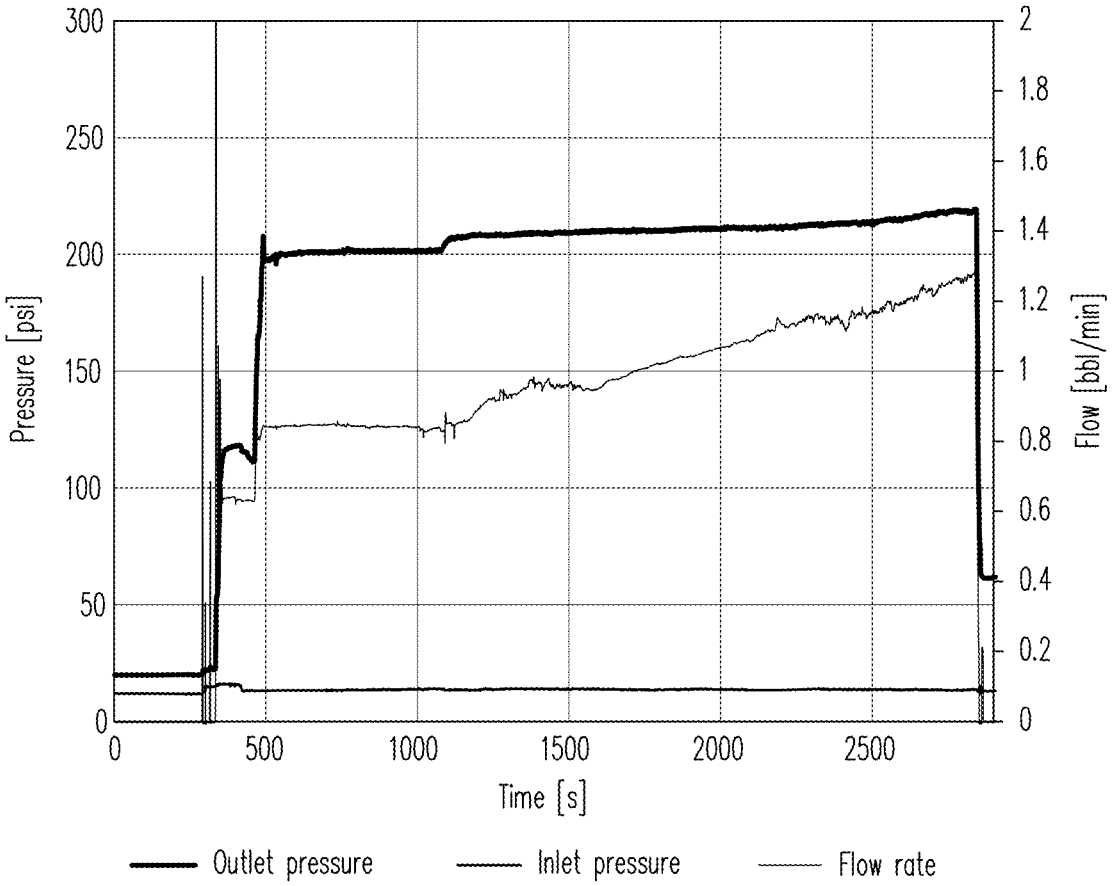
FIG. 3 (PRIOR ART)
FIG. 3 is a chart illustrating a change in fluid flow and pressure due to an increase in a perforation hole diameter, according to the prior art.
Figure 4A:
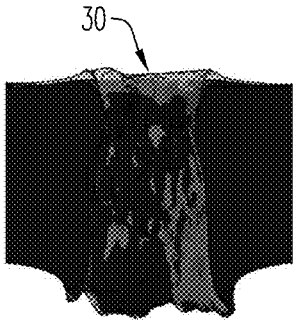
FIG. 4A (PRIOR ART)
FIG. 4A is a cross-sectional view of a perforation hole before it is eroded, according to the prior art.
Figure 4B:
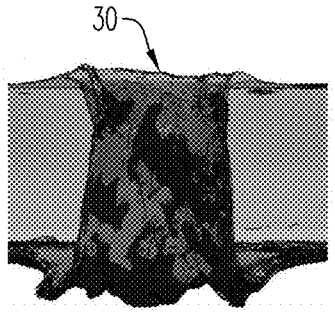
FIG. 4B (PRIOR ART)
FIG. 4B is a cross-sectional view of the perforation hole of FIG. 4A after it has been eroded.
Figure 5A:
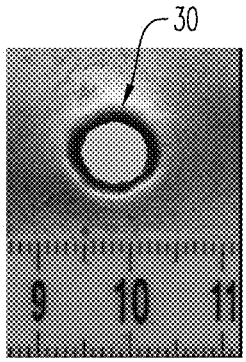
FIG. 5A (PRIOR ART)
FIG. 5A is a top view of a perforation hole before it is eroded, according to the prior art.
Figure 5B:
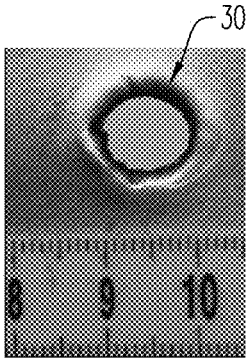
FIG. 5B (PRIOR ART)
FIG. 5B is a top view of the perforation hole of FIG. 5A after it has been eroded.
Figure 8:
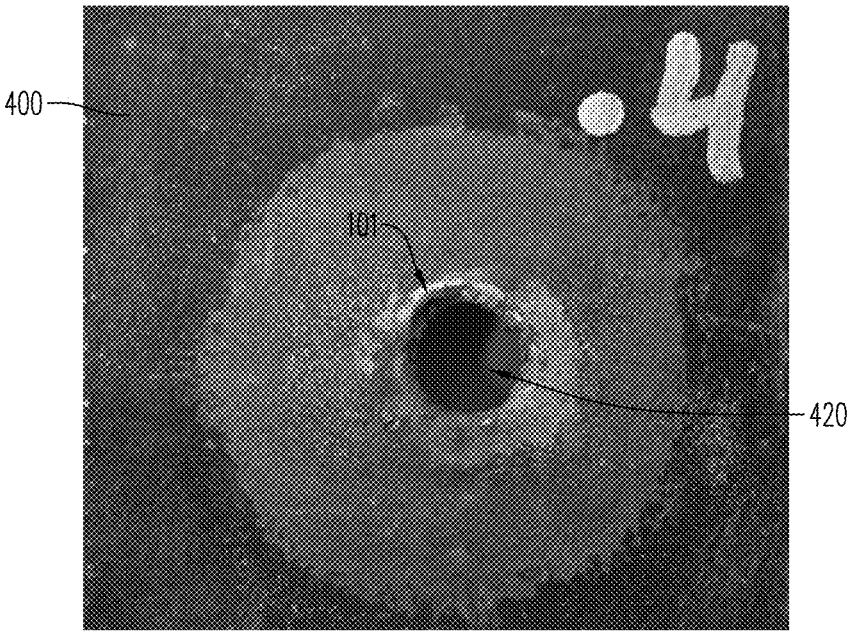
FIG. 8 is top view of a perforation hole formed using a shaped charge including a layer of material including a carbide layer or a metal nitride layer, according to an embodiment.
Figure 9:
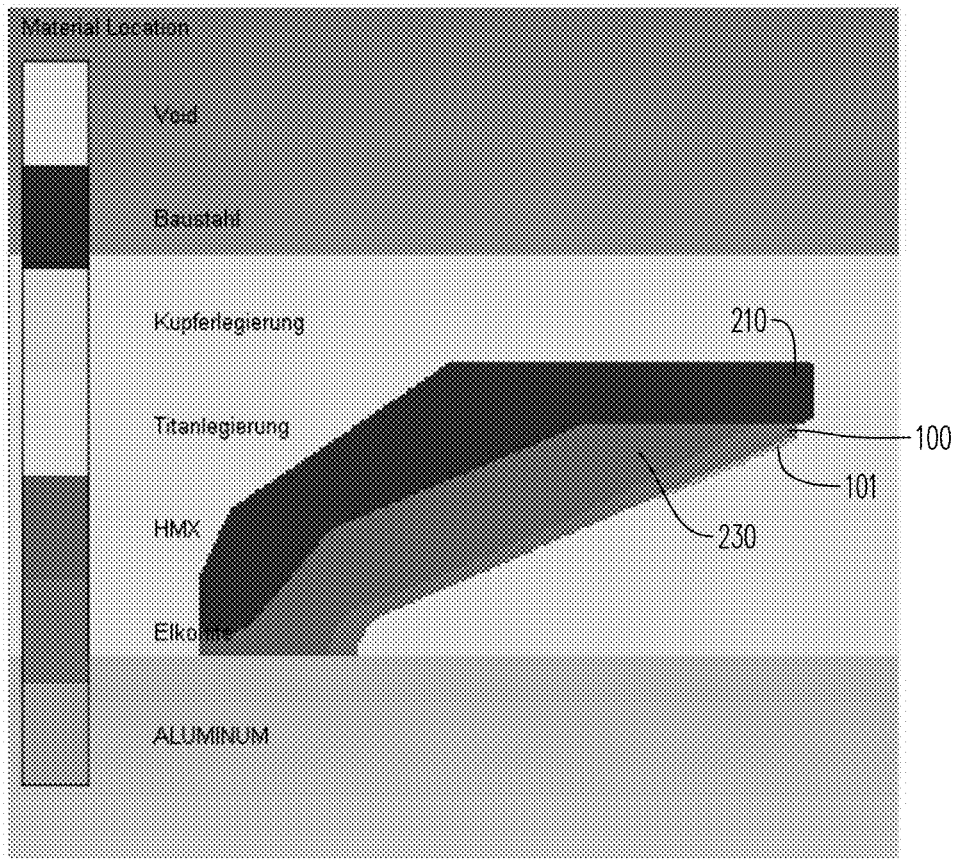
FIG. 9 is a cross-sectional view of the contents of a shaped charge, according to an aspect.

Upon detonation of a shaped charge including the liner 100, the shaped charge liner collapses in a configuration such that the carbide material or the nitride material of the layer of material 121 builds an outer shell or layer around the perforating/perforation/liner jet, which at least partially smashes or collides against a target surface, such as a wellbore casing 400. The carbide material or the nitride material of the layer of material 121 forms a halo, zone, or layer of carbide material or nitride material (illustrated as at least one material 101) around a perforation hole 420 formed in the target surface 400. The formed halo is illustrated in at least FIG. 8, FIG. 12E, and FIGS. 13-15. The halo is formed as a result of the carbide or nitride material adhering/sticking to the target surface 410 and the internal surface of the perforation 420 formed in the casing 400. As clearly illustrated in FIG. 8, the halo has a color or shade of a color that is different from the color or shade of color of the surface of the target, such as the surface of the wellbore casing 400. The halo in FIG. 8 has a lighter color that the surface of the target, which is more readily captured by an imaging device, as opposed to the surface of the target illustrated in FIG. 2

The contrast in color at the area of the perforation hole 420 creates an easily identifiable perforation hole 420, that is, a perforation hole may be easily identifiable using an optical downhole system (not shown). The optical downhole system may be provided as a component of a tool string for use in a wellbore. The tool string may be configured substantially as described in U.S. Provisional Patent Application No. 62/991,311 filed Mar. 18, 2020, commonly owned by DynaEnergetics Europe GmbH and incorporated herein by reference in its entirety to the extent that it is consistent with this disclosure.

According to an aspect, the tool string includes a perforating gun secured to a wireline, and an imaging device secured to the perforating gun. The tool string further includes a plug that is configured to expand and isolate the wellbore into a uphole region and a downhole region, such that the perforating gun and the imaging device are in the uphole region. The tool string, including the imaging device are run into the wellbore in a single trip. The imaging device includes an independent power source and a digital data memory to store images captured while the perforating gun and the imaging device are being moved in the uphole region of the wellbore, away from the plug.

The imaging device is configured to capture images of perforation holes 420 formed by the perforating gun in a wellbore. According to an aspect, the imaging device may be configured to use infrared or UV spectra for capturing the images of the perforation holes 420. Alternatively, images may be captured in a wavelength in the visible light spectrum, i.e., between about 400 nanometers and about 700 nanometers, or alternatively between 500 nanometers and about 650 nanometers. According to an aspect, the imaging device captures still images, continuous images (videos), or a combination of still and continuous images.

For use in conveyance methods other than wireline, for example, it is contemplated that the imaging device may be secured to any position on the tool string. Such conveyance methods may include coiled tubing or tubing conveyed perforating where the tool string can be pushed down the wellbore or pumped down the wellbore using wellbore fluid, then pulled out of the wellbore after creating perforation holes by the perforating gun.

It is further contemplated that the halo formed by layer of material 121 around the perforation 420 helps improve the erosion and/or corrosion resistance of the perforation hole. Because the layer of material 121 may include a material having a hardness that is greater than the hardness of the wellbore casing, when the layer of material 121 is transferred onto the surface or inlet burr of the perforation hole, it minimizes or substantially eliminates the rate of erosion that may be caused by abrasion of constituents of the proppant or slurry fluid.

The erosion rate reduction may be particularly important for well completion designs where designing the hydraulic fracturing process is based on the geometry of the perforation hole 420. In such well completion systems, it is desirable and essential to achieve both reliable and sustainable hole size diameters for wellbore operations, such as fracturing or fracking. Because an eroded perforation hole becomes larger during the fluid and proppant pumping process of fracking, such enlarged holes typically consume more of the fracturing fluid, and other neighboring smaller perforation holes may be unable to receive sufficient fracturing fluid to induce a fracture in area of the formation, which substantially reduces the effectiveness of the fracturing and reduces potential production from the formation. The shaped charge liner 100 helps to create a perforation hole 420 that can be easily captured by imaging devices, such as by the imaging device and tool string described hereinabove, and that withstands erosion and corrosion typically seen in standard perforation holes.

Further embodiments of the disclosure are associated with a shaped charge 200 for creating a perforation hole 420 in a wellbore casing 400. FIGS. 7A-7C, FIGS. 11A-11B, and FIGS. 12A-12D illustrate the shaped charge 200 in detail. The shaped charge 200 includes a case 210 defining a cavity 220. According to an aspect, the shaped charges 200 include an explosive load 230 disposed within the cavity 220 of the case 210. In an embodiment, the explosive load 230 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), and triaminotrinitrobenzol (TATB). According to an aspect, the explosive load 230 includes at least one of hexanitrostibane (HNS) and diamino-3,5-dinitropyrazine-1-oxide (LLM-105). The explosive load may include a mixture of PYX and TATB.

A shaped charge liner 100 may be disposed adjacent the explosive load 230, thus retaining the explosive load 230 within the cavity 220 of the case 210. For purposes of convenience, and not limitation, the general characteristics of the shaped charge liner 100 are described above with respect to at least FIGS. 6A-6C and FIGS. 7A-7C, and for purposes of convenience and not limitation, the general characteristics of the shaped charge liner 100 are not repeated hereinbelow.

The liner 100, while shown in a conical configuration in the shaped charges 200 of FIGS. 7A-7C, FIGS. 11A-11B and FIGS. 12A-12D may also be present in a hemispherical or tulip configuration. The liner 100 may include a composition that includes metal powders 130. The shaped charge liner 100 of the present disclosure may serve multiple purposes, such as, to maintain the explosive load 230 in place until detonation, and to accentuate the explosive effect on the surrounding geological formation.

The liner 100 of the shaped charge 200 may be formed to a desired shape prior to being placed/installed within the shaped charge case 210. In an embodiment, the liner 100 is pre-pressed to its desired shape, and thereafter installed in the shaped charge case 210 by being machined or manually placed onto the explosive load 230.

The shaped charge liner 100 of the shaped charge 200 may include at least one material 101 having hardness that is greater than a corresponding hardness of the wellbore casing 400. The at least one material 101 may be configured to bond to at least one of an outer surface and an inner surface of the perforation hole 420 formed upon detonation of the shaped charge 200 and penetration of the casing 400 by a perforation jet. According to an aspect, the at least one material 101 may be configured to increase the erosion resistance of the wellbore casing 400. The at least one metal may include carbide, nitride, or molybdenum. Alternatively, the at least one metal is titanium nitride. FIGS. 12B-12D illustrate the jet formation process upon detonation of the shaped charge 200. The liner 100 elongates upon detonation of the shaped charge 200, such that the at least one material 101 collides against a target surface surrounding the formed perforation hole. As illustrated in FIG. 12E, the collision affixes some of the at least one material 101 onto the surface to form the halo around the perforation hole 420.

Further embodiments of the disclosure are associated with a perforating gun assembly 600 including a plurality of shaped charges 200 having a shaped charge liner 100 as described herein. The perforating gun 600 is generally represented in FIGS. 12A-12D as a barrier that is pierced by the perforating jet 700 before the perforating jet 700 creates the perforation hole 420 in the wellbore casing 400.

Figure 10:
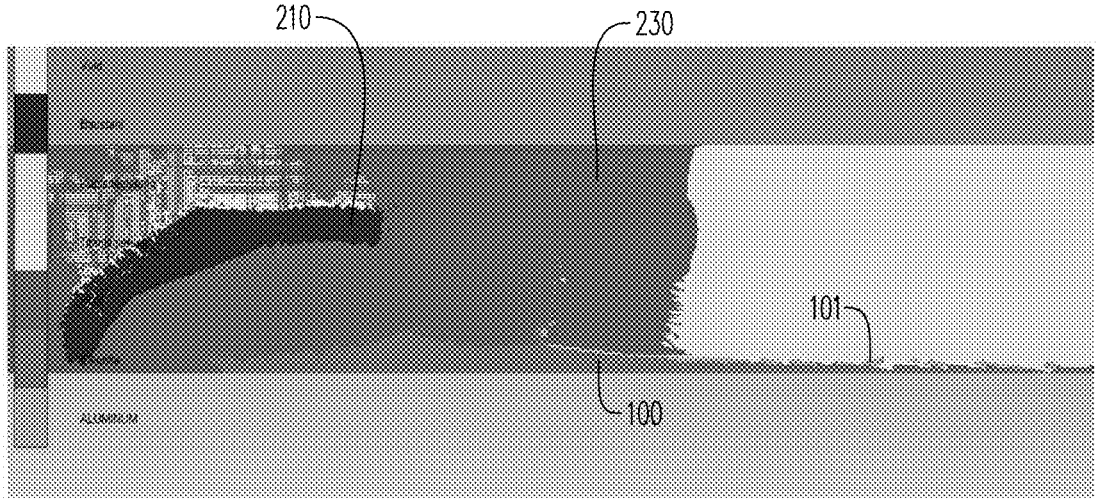
FIG. 10 is an illustration of the formation of a perforating jet formed upon detonation of a shaped charge configured as illustrated in FIG. 9.

Further embodiments of the disclosure are associated with a wellbore completion method including the use of a perforating gun assembly including the aforementioned shaped charges. The perforating gun assembly forms perforations having a halo coated with carbide or nitride that helps improve the erosion and/or corrosion resistance of the perforation hole and helps to facilitate the capturing of the formed perforation holes using an imaging device. Once the shaped charges detonate, they may form a hole/opening 610 in the perforating gun housing Further embodiments of the disclosure are associated with a shaped charge including a layer of material on an exposed or outer surface of a liner positioned in the shaped charge. The layer of material may include titanium nitride (TiN). FIG. 10A illustrates the layer of titanium nitride being a coating that has been applied onto the outer surface of the liner. As seen in, for example, FIGS. 10A and 10B, the titanium carbide is positioned at a position between the apex and the open end of the liner. According to an aspect, the titanium nitride may be a separate structure, such as, for example, a foil that is adhered to or otherwise secured to the liner.

Further embodiments of the disclosure are associated with a method of perforating a target. The method includes deploying a perforating gun in a wellbore. The perforating gun includes a shaped charge configured substantially as described hereinabove. The shaped charge includes a shaped charge liner having at least one metal including a carbide or nitride material. Alternatively, the shaped charge liner may include a carbide layer or nitride layer. The method further includes detonating the shaped charge 200 to create a perforation hole in a target. The created perforation hole has an inlet burr. A carbide or nitride material, supplied by the shaped charge liner, is deposited onto the inlet burr. The method may further include coating a peripheral edge portion of the perforation hole with at least some of the carbide or nitride material. According to an aspect, the carbide material or nitride material helps to increase the corrosion resistance of the perforation hole.

According to an aspect, the method further includes altering at least one of surfaces of the inlet burr and a peripheral edge of the perforation hole to change the color of the target, such that the perforation hole is visible to an optical downhole system. The carbide material or nitride material may increase the visibility of the perforation hole so that images can be readily captured by the optical downhole system.

Figure 12A:
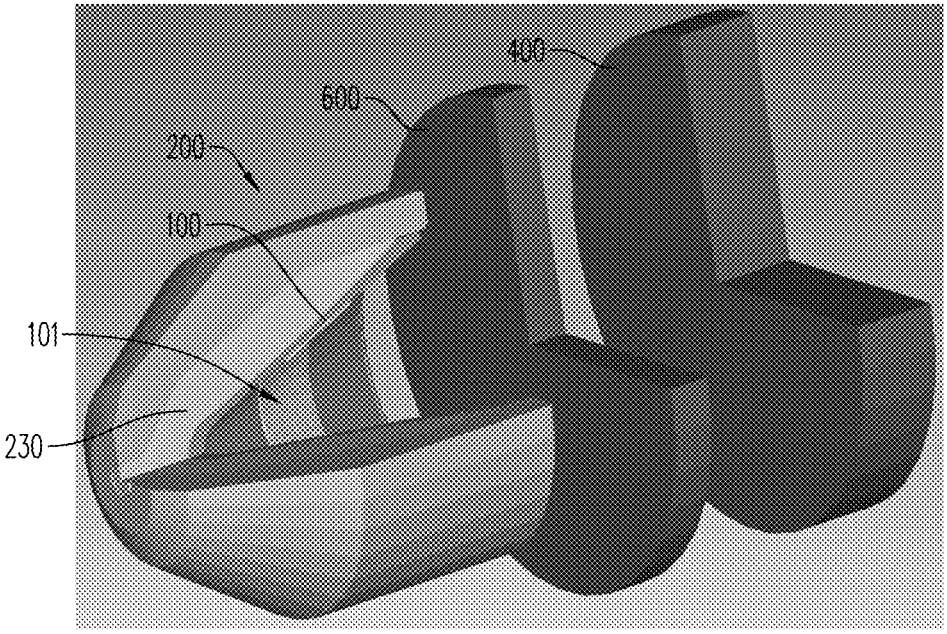
FIG. 12A is a partial cross-sectional view of a shaped charge having an open end facing a first metal plate and a second metal plate, according to an aspect.
Figure 12B:
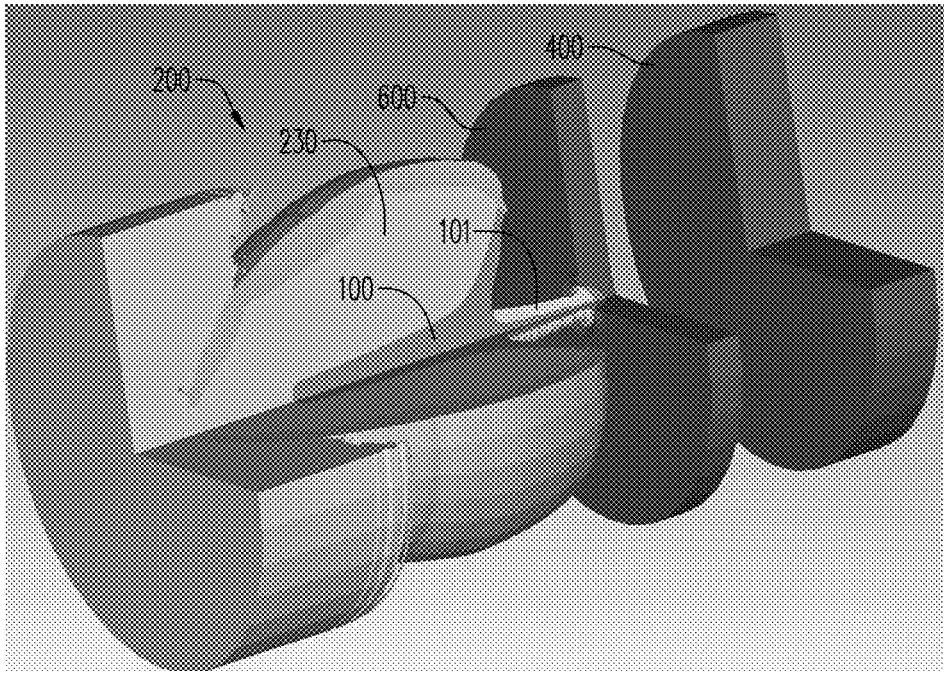
FIG. 12B is a partial cross-sectional view of the shaped charge, the first metal plate and the second metal plate of FIG. 12A, illustrating the formation of a perforating jet, according to an aspect.
Figure 12C:
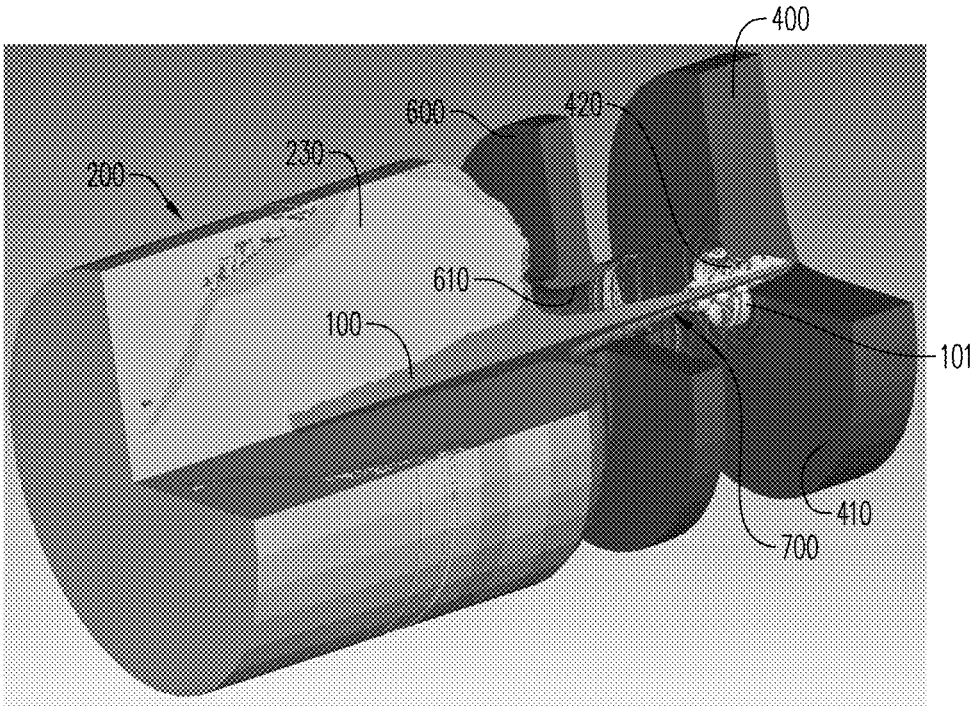
FIG. 12C is a partial cross-sectional view of the shaped charge, the first metal plate and the second metal plate of FIG. 12A, illustrating the penetration of the perforating jet of FIG. 11B through the first metal plate, according to an aspect.
Figure 12D:
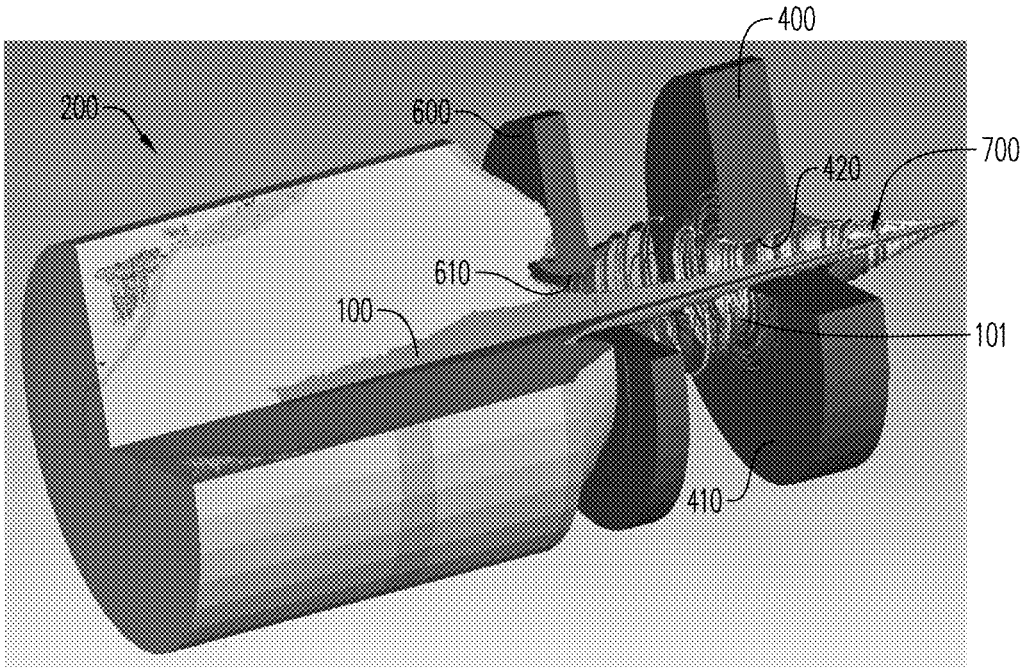
FIG. 12D is a partial cross-sectional view of the shaped charge, the first metal plate and the second metal plate of FIG. 12A, illustrating the penetration of the perforating jet through the second metal plate, according to an aspect.
Figure 12E:
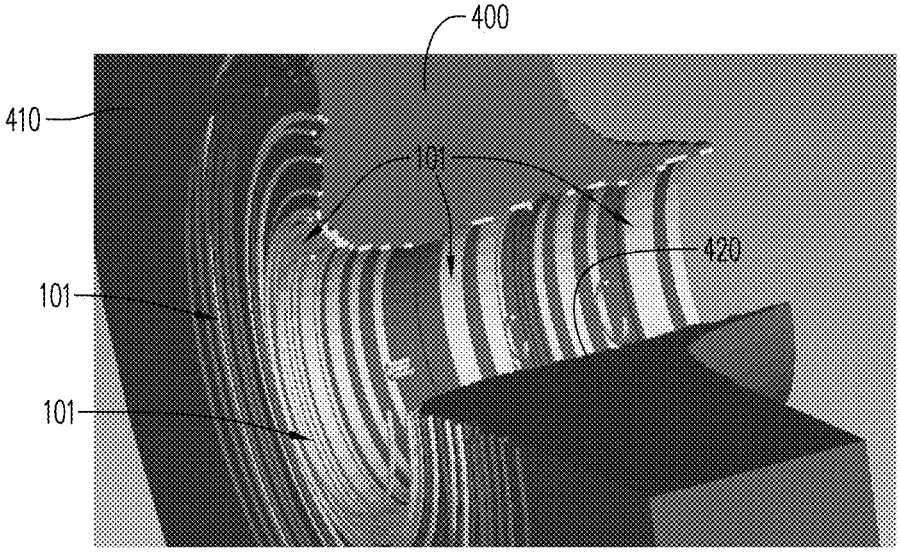
FIG. 12E is a partial cross-sectional view of the second metal plate, illustrating a perforation hole formed in the second metal plate, according to an aspect.

FIGS. 12A to 12E illustrate the process or evolution of a perforation jet 700 formed upon detonation of a shaped charge including a layer of at least one metal including a carbide material, such as titanium nitride, positioned between the apex and the open end of a liner 110, according to an aspect. FIGS. 12A to 12E reflect a simulation of the perforating jet formation. FIG. 12A illustrates the shaped charge 200 positioned with its open end facing a first metal plate, representative of a body of a perforating gun 600 and a second metal plate, representative of a target wellbore casing 400. FIG. 12B illustrates the initial stage of j et formation and shows a combination of the liner 100 and the layer of at least one material 101 or the layer of material first contacting and slightly penetrating a surface of the first metal plate. FIG. 12C illustrates further formation of the perforation jet 700 and shows a hole formed in the first metal plate and the perforation jet 700 penetrating an upper 410 the second metal plate. As seen in FIG. 12C and FIG. 12D, the layer of at least one material contacts the upper surface 410 of the second metal plate, surrounding a perforation hole 420, and also coats at least a portion of the internal surface (or inlet burr 430) of the perforation hole 420. The carbide material of the coating places itself around the perforating jet 700 like a mantle and smashes against the casing plate. Due to the high velocity of the perforating jet 700, the carbide material is bonded to the surfaces of the target and creates an erosion protection layer at the perforation hole. According to an aspect, the carbide material may adhere to the surface of the perforation hole by the physical impact and high temperature associated with the perforating jet. The carbide material (or the nitride material) may be chemically bonded to the surface of the target and/or the perforation hole. FIG. 12E illustrates the coated outer surface of the perforation hole and the coated internal surface of the perforation hole.

Figure 11A:
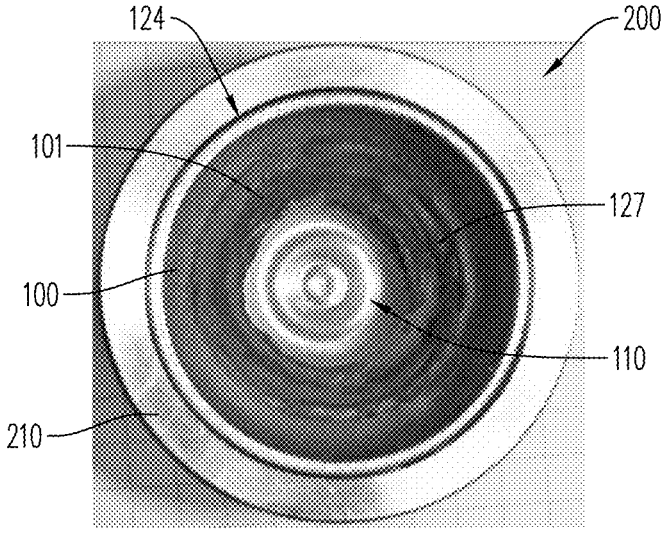
FIG. 11A is top down view of a shaped charge for use with a perforating gun assembly, according to an embodiment.
Figure 11B:
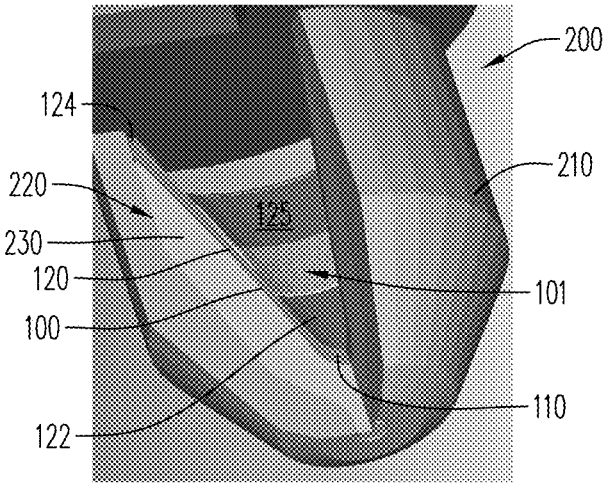
FIG. 11B is a partial cross-sectional view of the shaped charge of FIG. 10A.
Figure 13:
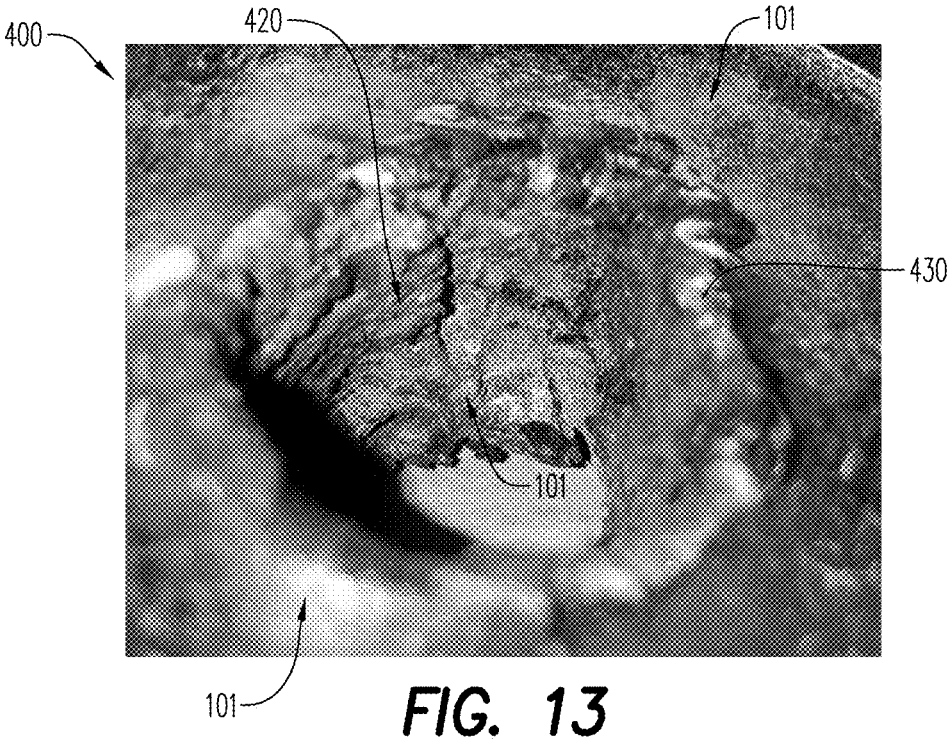
FIG. 13 is a perspective view of a perforation hole formed upon detonation of the shaped charge of FIG. 11A, according to an aspect.
Figure 14:
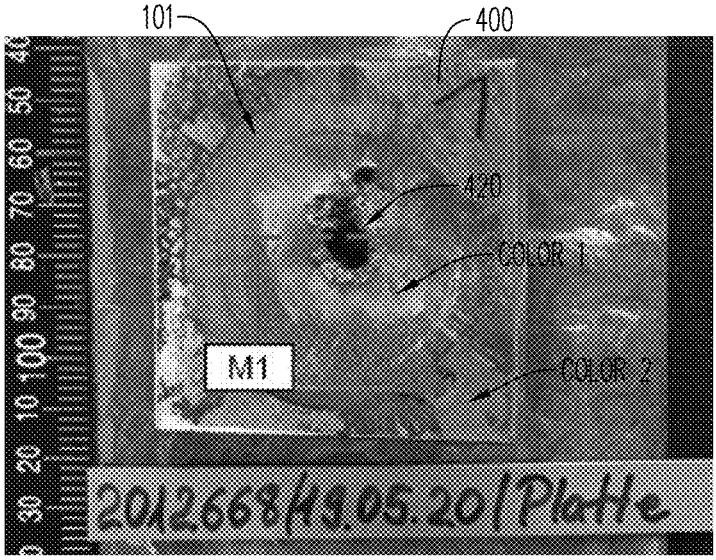
FIG. 14 is a top view of a perforation hole formed upon detonation of a shaped charge, according to an aspect.

FIG. 13 is a perspective view of a perforation hole that was created upon detonation of a shaped charge 200 configured as illustrated in FIG. 11A and FIG. 11B. The internal surface of the perforation hole 420 is coated with the at least one material, which may include titanium nitride.

Embodiments of the disclosure may further be associated with a shaped charge including a layer of tungsten carbide on an exposed or outer surface of a liner positioned in the shaped charge. The layer of tungsten carbide may be coated or otherwise applied on or adhered to the outer surface of the liner. Similar to the embodiment illustrated in FIGS. 11A and 11B, the layer of tungsten carbide may be positioned at a position between the apex and the perimeter 124 of the liner 100.

Figure 15:
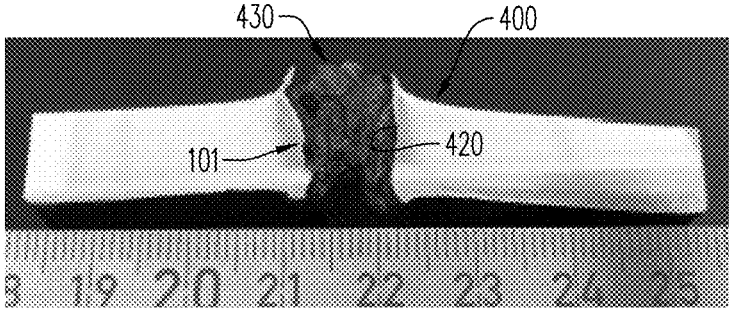
FIG. 15 is a cross-sectional view of the perforation hole of FIG. 14.
Figure 16:
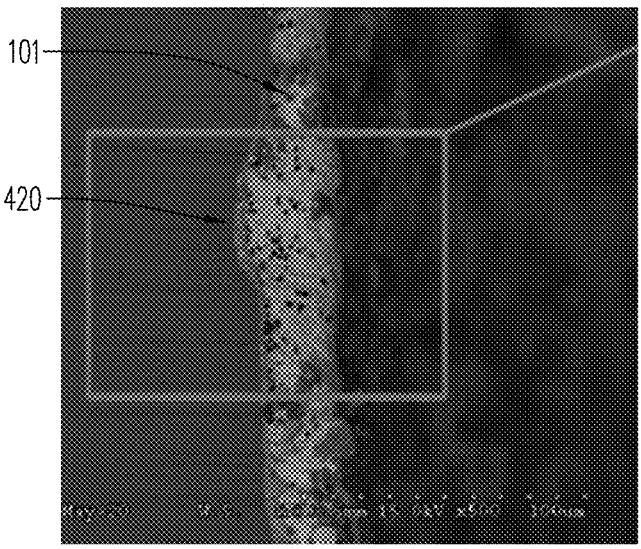
FIG. 16 illustrates a coated surface of the perforation hole of FIG. 15.

FIGS. 13-16 illustrate a perforation hole formed in a wellbore casing 400. Tungsten carbide is shown as having been deposited around (FIG. 13 and FIG. 14) and in (FIG. 13 and FIG. 15) the perforation hole 420 of the wellbore casing 400. The tungsten carbide forms a halo around the perforation hole formed in the wellbore casing 400. The wellbore casing 400 illustrated in FIG. 15 is a cut through portion of the wellbore casing 400 illustrated in FIG. 14. As clearly seen, the surface of the perforation hole 420 is a lighter color than other surfaces of the wellbore casing 400, illustrating the presence of tungsten carbide in the perforation hole 420. An SEM analysis of the perforation hole 420, illustrated in FIG. 16, shows a closeup view of the tungsten carbide coated perforation hole 420.

EXAMPLES

Various compositions for use in shaped charge liners may be made according to the embodiments of the disclosure. The percentages presented in the Examples shown in Table 1, Table 2 and Table 3 are based on the total % w/w of the powders in the composition and exclude reference to de minimis amounts of processing oils or lubricants that may be utilized. Such oils or lubricants may be present in a final mix in an amount of between about 0.01% and 1% of the total % w/w of the powders in the composition. The copper-coated tungsten carbide referenced in Table 1 may include up to 99.5% tungsten carbide, coated with up to 10% copper. The copper-premix referenced in Table 3 may include up to about 20% lead and about 80% copper.

TABLE 1

| Shaped Charge Liner-Sample Composition 1 | Liner Blend (%) w/w |
|---|---|
| Copper-coated Tungsten Carbide | 20-90% |
| Lead | 0-80% |
| Tin | 0-60% |
| Aluminum | 0-20% |

TABLE 2

| Shaped Charge Liner-Sample Composition 4 | Liner Blend (%) w/w |
|---|---|
| Titanium Nitrate | 20-90% |
| Lead | 0-80% |
| Tin | 0-60% |
| Aluminum | 0-20% |

TABLE 3

| Shaped Charge Liner-Sample Composition 3 | Liner Blend (%) w/w |
|---|---|
| Copper-coated Tungsten Carbide | 10-90% |
| Copper-premix | 10-90% |

FIGS. 17A-17F illustrate additional SEM analysis of perforation holes 420 created by using shaped charges including liners configured according to the disclosure. Each liner included a mixture of 50% copper premix and 50% copper-coated tungsten. Once the shaped charges were shot through a target (steel coupon), the steel coupon was cut in half to view the perforation hole and conduct SEM analysis. A spectrometer was used to view the perforation holes.

Figure 17A:
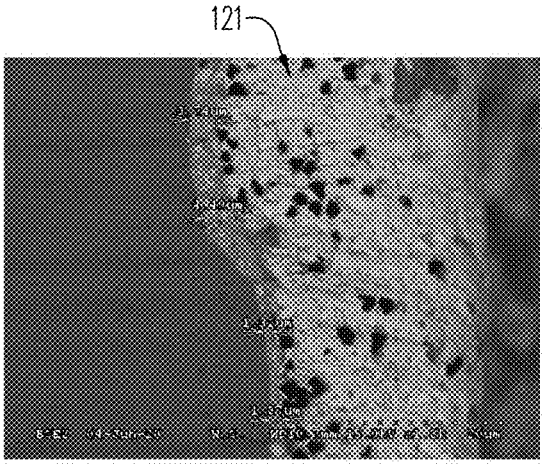
FIG. 17A illustrates SEM analysis data of a side wall of a perforation hole including a layer of material deposited around the edge of the perforation hole, according to an aspect.
Figure 17B:
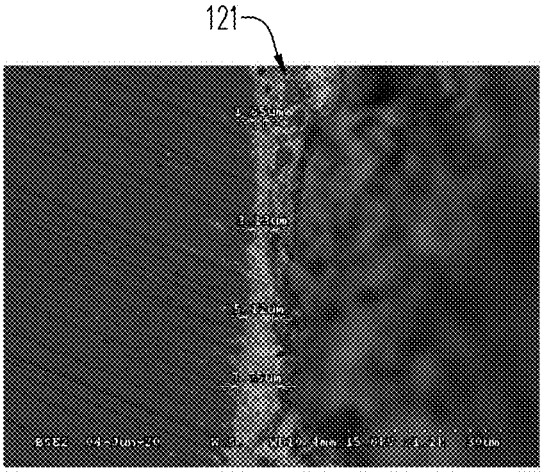
FIG. 17B illustrates SEM analysis data of a side wall of a perforation hole a side wall of a perforation hole including a layer of material deposited around the edge of the perforation hole, according to an aspect.
Figure 17C:
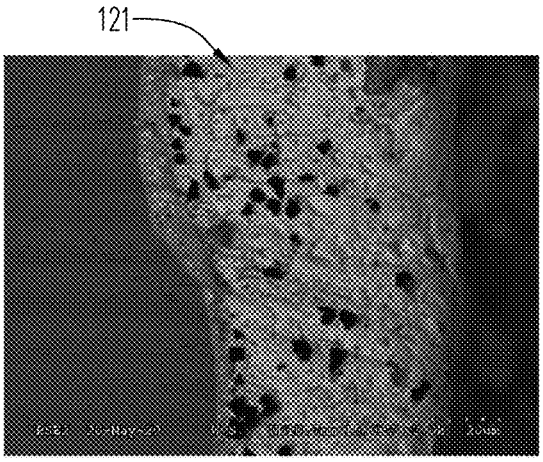
FIG. 17C illustrates SEM analysis data of a side wall of a perforation hole including a layer of material deposited around the edge of the perforation hole, according to an aspect.
Figure 17D:
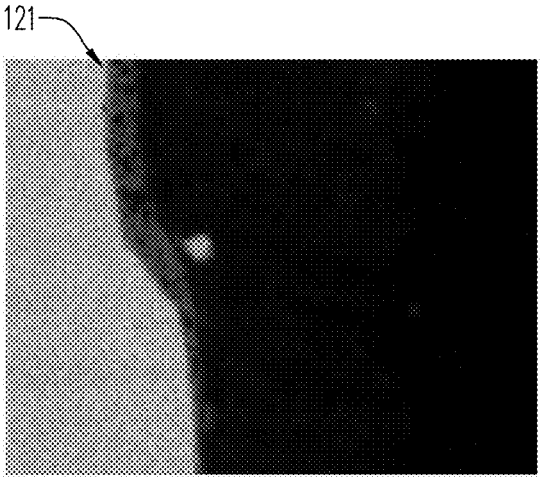
FIG. 17D illustrates SEM analysis data of a perforation hole including iron deposited around the perforation hole.
Figure 17E:
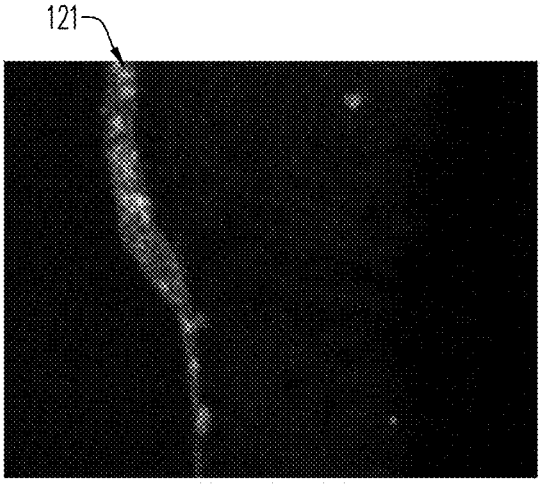
FIG. 17E illustrates SEM analysis data of a perforation hole including tungsten carbide deposited around the perforation hole.
Figure 17F:
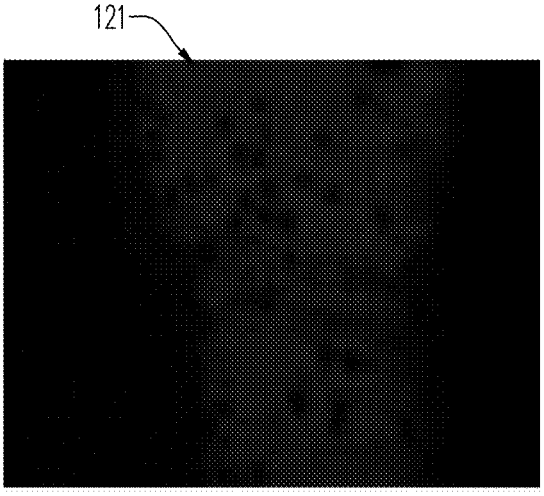
FIG. 17F illustrates SEM analysis data of a perforation hole including lead deposited around the perforation hole.

Each of FIG. 17A, FIG. 17B and FIG. 17C illustrates SEM analysis data of a side wall of the perforation hole. A layer of material 121 is illustrated as having been deposited around the edge of the perforation hole. FIG. 17D illustrates SEM analysis data of a perforation hole including a layer of material 121. The layer of material 121 illustrated is iron, and it was deposited around the perforation hole. FIG. 17E illustrates SEM analysis data of a perforation hole including a layer of material 121 deposited around the perforation hole. The layer of material 121 was tungsten carbide. FIG. 17F illustrates SEM analysis data of a perforation hole including a layer of material 121 deposited around the perforation hole. The layer of material 121 was lead.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above.

For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A shaped charge liner comprising:
an apex portion; and
a skirt portion extending from the apex portion, the skirt portion comprising:
a body connected to the apex portion,
a perimeter spaced apart from the apex portion, and
a layer of material extending between and spaced apart from the perimeter and the apex portion, wherein
the layer of material includes a lacquer applied to a surface of the body, and
the lacquer includes a carbide layer or a metal nitride layer.

2. The shaped charge liner of claim 1, wherein the layer of material comprises a foil adhered to a surface of the body.

3. The shaped charge liner of claim 1, wherein the layer of material comprises one of tungsten carbide, titanium carbide, and boron carbide.

4. The shaped charge liner of claim 1, further comprising:
a plurality of metal powders.

5. The shaped charge liner of claim 1, wherein
the layer of material includes a powder comprising carbide or nitride, and
the powder is combined with a plurality of metal powders.

6. The shaped charge liner of claim 1, wherein the layer of material comprises a plurality of spaced apart carbide layers or a plurality of spaced apart nitride layers.

7. A shaped charge for creating a perforation hole in a wellbore casing, the shaped charge comprising:
a shaped charge liner comprising at least one material having a hardness that is greater than a corresponding hardness of the wellbore casing,
wherein the at least one material is configured to bond to at least one of an outer surface and an inner surface of the perforation hole upon detonation of the shaped charge and penetration of the casing by a perforation jet, and
wherein the at least one material comprises a lacquer applied to a surface of the shaped charge liner, and the lacquer comprises carbide, nitride or molybdenum.

8. The shaped charge of claim 7, wherein the at least one material increases erosion resistance of the wellbore casing upon detonation of the shaped charge.

9. The shaped charge of claim 7, wherein the at least one material further comprises titanium nitride.

10. The shaped charge of claim 7, further comprising:
a case having a cavity; and
an explosive load disposed within the cavity of the case, wherein the liner is disposed adjacent the explosive load.

11. The shaped charge of claim 7, wherein the liner further comprises:
an apex portion; and
a skirt portion extending from the apex portion, the skirt portion comprising:
a body connected to the apex portion, and
a perimeter spaced apart from the apex portion.

12. The shaped charge of claim 11, wherein
the at least one material comprises a carbide layer extending between and spaced apart from the perimeter and the apex.

13. The shaped charge of claim 12, wherein the carbide layer comprises a foil adhered to a surface of the body.

14. A shaped charge liner comprising:
an apex portion; and
a skirt portion extending from the apex portion, the skirt portion comprising:
a body connected to the apex portion,
a perimeter spaced apart from the apex portion, and
a layer of material extending between and spaced apart from the perimeter and the apex portion, wherein the layer of material includes a plurality of spaced apart layers, the plurality of spaced apart layers comprising one of carbide and nitride.

15. The shaped charge liner of claim 14, wherein the layer of material comprises a foil adhered to a surface of the body.

16. The shaped charge liner of claim 14, wherein the plurality of spaced apart layers comprises one of tungsten carbide, titanium carbide, tantalum, and boron carbide.

17. The shaped charge liner of claim 14, wherein
the layer of material includes a powder, and
the powder is combined with a plurality of metal powders.

18. The shaped charge liner of claim 14, further comprising:
a plurality of metal powders compressed to form the body of the shaped charge liner,
wherein the layer of material comprises a lacquer applied to the body of the shaped charge liner.

* * * * *